US009728328B2

(12) United States Patent
Lee

(10) Patent No.: US 9,728,328 B2
(45) Date of Patent: Aug. 8, 2017

(54) TRANSFORMER WITH BOBBIN FOR PREVENTING CRACK, LOW VOLTAGE DC-DC CONVERTER HAVING THE SAME, AND METHOD FOR ASSEMBLING THE SAME

(71) Applicant: HYUNDAI MOBIS CO., LTD., Seoul (KR)

(72) Inventor: Jong-Hyeok Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 175 days.

(21) Appl. No.: 14/693,751

(22) Filed: Apr. 22, 2015

(65) Prior Publication Data

US 2015/0340152 A1 Nov. 26, 2015

(30) Foreign Application Priority Data

May 20, 2014 (KR) ..... 10-2014-0060353

(51) Int. Cl.

| | |
|---|---|
| ***H01F 27/30*** | (2006.01) |
| ***H01F 30/06*** | (2006.01) |
| ***H01F 27/24*** | (2006.01) |
| ***H01F 41/02*** | (2006.01) |
| ***H01F 27/28*** | (2006.01) |
| ***H01F 27/32*** | (2006.01) |

(52) U.S. Cl.

CPC ..... *H01F 30/06* (2013.01); *H01F 27/24* (2013.01); *H01F 27/2847* (2013.01); *H01F 27/30* (2013.01); *H01F 27/306* (2013.01); *H01F 27/324* (2013.01); *H01F 41/0206* (2013.01); *H01F 2027/2861* (2013.01); *Y10T 29/49076* (2015.01)

(58) Field of Classification Search

CPC ..... H01F 27/00–27/30
USPC ..... 336/55–62, 196, 198
See application file for complete search history.

(56) References Cited

U.S. PATENT DOCUMENTS 6,087,917 A 7/2000 Roessler et al.

FOREIGN PATENT DOCUMENTS

| | | | |
|---|---|---|---|
| JP | 60200505 A | * | 10/1985 |
| JP | 8321423 A | | 12/1996 |
| KR | 10-2003-0075848 A | | 9/2003 |
| KR | 10-2005-0103526 A | | 10/2005 |

* cited by examiner

*Primary Examiner* — Tuyen Nguyen
(74) *Attorney, Agent, or Firm* — Knobbe Martens Olson & Bear LLP

(57) ABSTRACT

A transformer with a bobbin for preventing a crack may include a lower core configured to be provided with a lower assembling jaw, a bobbin for preventing a crack configured to have a center rib which is provided with a lower core crack preventing part inserted into the lower assembling jaw and an upper core crack preventing part formed at an opposite side to the lower core crack preventing part, having a predetermined thickness, a bus bar configured to penetrate through the center rib, an insulating plate configured to be stacked on an upper end surface of the bus bar, and an upper core inserted into the insulating plate and the bus bar and inserted into the upper core crack preventing part.

14 Claims, 6 Drawing Sheets

TRANSFORMER WITH BOBBIN FOR PREVENTING CRACK, LOW VOLTAGE DC-DC CONVERTER HAVING THE SAME, AND METHOD FOR ASSEMBLING THE SAME

CROSS-REFERENCE(S) TO RELATED APPLICATION(S)

This application claims the benefit of priority to Korean Patent Application No(s). 10-2014-0060353 filed on May 20, 2014, the entire contents of which are incorporated herein by reference.

BACKGROUND

Field

Embodiments of the present invention relate to a transformer, and to a method of manufacturing capable of reducing man hours at the time of assembling or reworking.

Description of Related Art

A hybrid vehicle driven by an engine and a motor and an electric vehicle driven only by a motor require a high voltage and a high current when the hybrid vehicle and the electric vehicle drive the motor, and therefore require a hybrid power control unit (HPCU) which is a power control unit. The HPCU is configured to include power supply products such as a low voltage DC-DC converter (LDC), an inverter, and a hybrid control unit (HCU).

Among those, the LDC is configured to include a power unit for changing a high voltage input into a low voltage input and a control unit for controlling the same. The power unit is configured to largely include a power board, a transformer, an output board, and the like, and the control unit is configured to include a control board.

Among those, in the case of magnetic components (for example, resonance choke, transformer, inductor, and the like), a circuit is configured by generating an inductance value using ferrite which is a sintering material.

SUMMARY

An embodiment of the present invention is directed to providing a transformer with a bobbin for preventing a crack and a low voltage DC-DC Converter having the same capable of replacing a function of epoxy or impregnation with the bobbin.

Another embodiment of the present invention is directed to providing cost savings by reducing the number of components to be assembled to improve workability and post-workability.

Other aspects and advantages of the present invention can be understood by the following description, and become apparent with reference to the embodiments of the present invention. Also, it is obvious to those skilled in the art to which the present invention pertains that the aspects and advantages of the present invention can be realized by the means as claimed and combinations thereof.

In accordance with an embodiment of the present invention, the transformer with a bobbin for preventing a crack includes: a lower core configured to be provided with a lower assembling jaw; a bobbin for preventing a crack configured to have a center rib which is provided with a lower core crack preventing part inserted into the lower assembling jaw and an upper core crack preventing part formed at an opposite side to the lower core crack preventing part, having a predetermined thickness; a bus bar configured to penetrate through the center rib; an insulating plate configured to be stacked on an upper end surface of the bus bar; and an upper core inserted into the insulating plate, the bus bar, and the upper core crack preventing part.

The predetermined thickness may be a thickness of a barrier plate which is integrally formed inside the center rib.

The predetermined thickness may be an interval of a gap difference between the lower assembling jaw and the upper assembling jaw.

When the gap difference between the lower assembling jaw and the upper assembling jaw is equal to or more than a predetermined value, a gap reinforcing rib may be formed on at least one of an upper end and a lower end of the barrier plate.

A material of the bobbin for preventing a crack may be poly phenylene sulfide (PPS) or poly amide (PA) 46+ glass fiber (GF) 30 which is a heat resistant resin.

A material of the bus bar may be pure copper or copper plated with tin.

The barrier plate may be injection-molded simultaneously with the center rib.

In accordance with another embodiment of the present invention, a low voltage DC-DC converter includes: the transformer described above; a power board configured to supply power to the transformer; and an output board configured to output power transformed by the transformer.

In accordance with still another embodiment of the present invention, an assembling method of a transformer with a bobbin for preventing a crack includes: disposing a lower core provided with a lower assembling jaw; assembling a bobbin for preventing a crack configured to have a center rib provided with a lower core crack preventing part inserted into the lower assembling jaw and an upper core crack preventing part which is formed at an opposite side to the lower core crack preventing part, having a predetermined thickness; penetrating a bus bar through the center rib; stacking an insulating plate on an upper end surface of the bus bar; and inserting the upper core into the insulating plate, the bus bar, and the upper core crack preventing part.

DESCRIPTION OF SPECIFIC EMBODIMENTS

Figure 1:
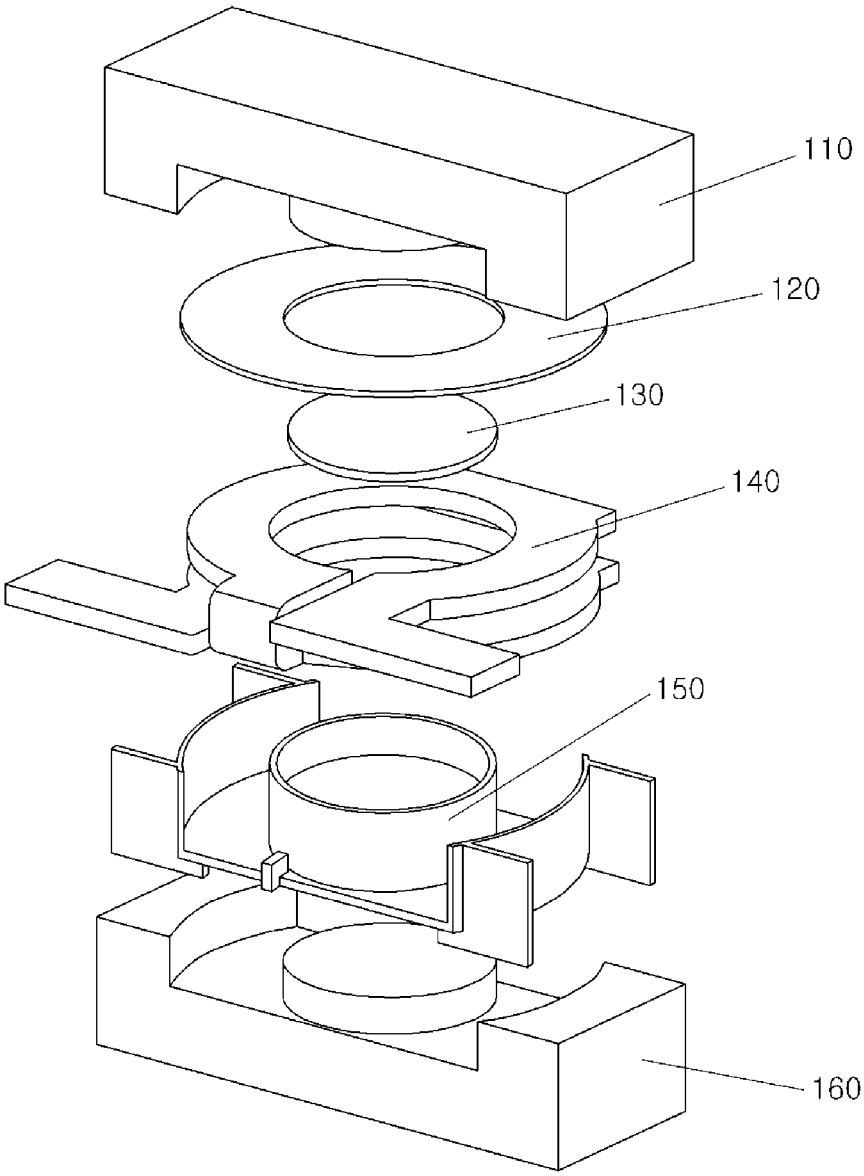
FIG. 1 is an assembly view of a general transformer.

Since the present invention may be variously modified and have several embodiments, specific embodiments will be shown in the accompanying drawings and be described in detail in a detailed description. However, it is to be understood that the present invention is not limited to the specific embodiments, but includes all modifications, equivalents, and substitutions included in the spirit and the scope of the present invention.

Throughout the accompanying drawings, the same reference numerals will be used to describe the same components.

Terms used in the specification, 'first', 'second', etc., may be used to describe various components, but the components are not to be interpreted to be limited to the terms. The terms are used to distinguish one component from another component.

Therefore, the first component may be referred to as the second component, and the second component may be referred to as the first component. The term 'and/or' includes a combination of a plurality of items or any one of a plurality of terms.

Unless indicated otherwise, it is to be understood that all the terms used in the specification including technical and scientific terms have the same meaning as those that are understood by those who skilled in the art.

It must be understood that the terms defined by the dictionary are identical with the meanings within the context of the related art, and they should not be ideally or excessively formally defined unless the context clearly dictates otherwise.

Hereinafter, embodiments of the present invention will be described in detail with reference to the accompanying drawings.

A HPCU is configured to include the power supply products such as the low voltage DC-DC converter (LDC), the inverter, and the hybrid control unit (HCU).

FIG. 1 illustrates an assembly view of a transformer. Referring to FIG. 1, when the transformer is assembled, the transformer is configured of a total of six components. The transformer is assembled in an assembling order of a lower core 160, a bobbin 150, a bus bar 140, an epoxy 130, an insulating plate 120, and an upper core 110.

In the case of the cores 110 and 160, there are a no-gap type and a gap type, which is divided depending on whether a gap is present in a portion at which an upper core meets the lower core.

The NO-GAP type is mainly applied to the transformer and the GAP type has been mainly used in the resonance choke or an output inductor.

Among those, in the case of the GAP type, an L value is determined based on the gap between the lower core and the upper core. However, a magnetic core is a sintered product and therefore is vulnerable to shocks and may be broken by a clamp force or a worker at the time of assembling.

Due to the badness phenomenon, the LDC assembly is damaged and thus a vehicle results in stopping. Therefore, to prevent the breakage, the upper and lower cores are fixed by epoxy or impregnation.

However, in the case of the epoxy, use temperature is low and in the case of the impregnation, the upper and lower cores are covered with a kind of silicon, and thus the bus bar may not radiate heat well. Therefore, the bobbin is melted or a function of the core is lost due to the increase in internal temperature, and thus a function of the LDC is lost or smoothing is not performed, thereby applying an electrical damage to counter components of a vehicle side.

Further, in the case of the epoxy or the impregnation, the epoxy is not hard until it suffers from a hardening process at about 100° C. for about 2 hours, and therefore. material cost may be increased. In particular, in the case of the impregnation, the magnetic core and internal components are fixed and thus no gap is present, such that it is difficult to assemble the LDC assembly and when defects occur, the internal components may be discarded.

Figure 2:
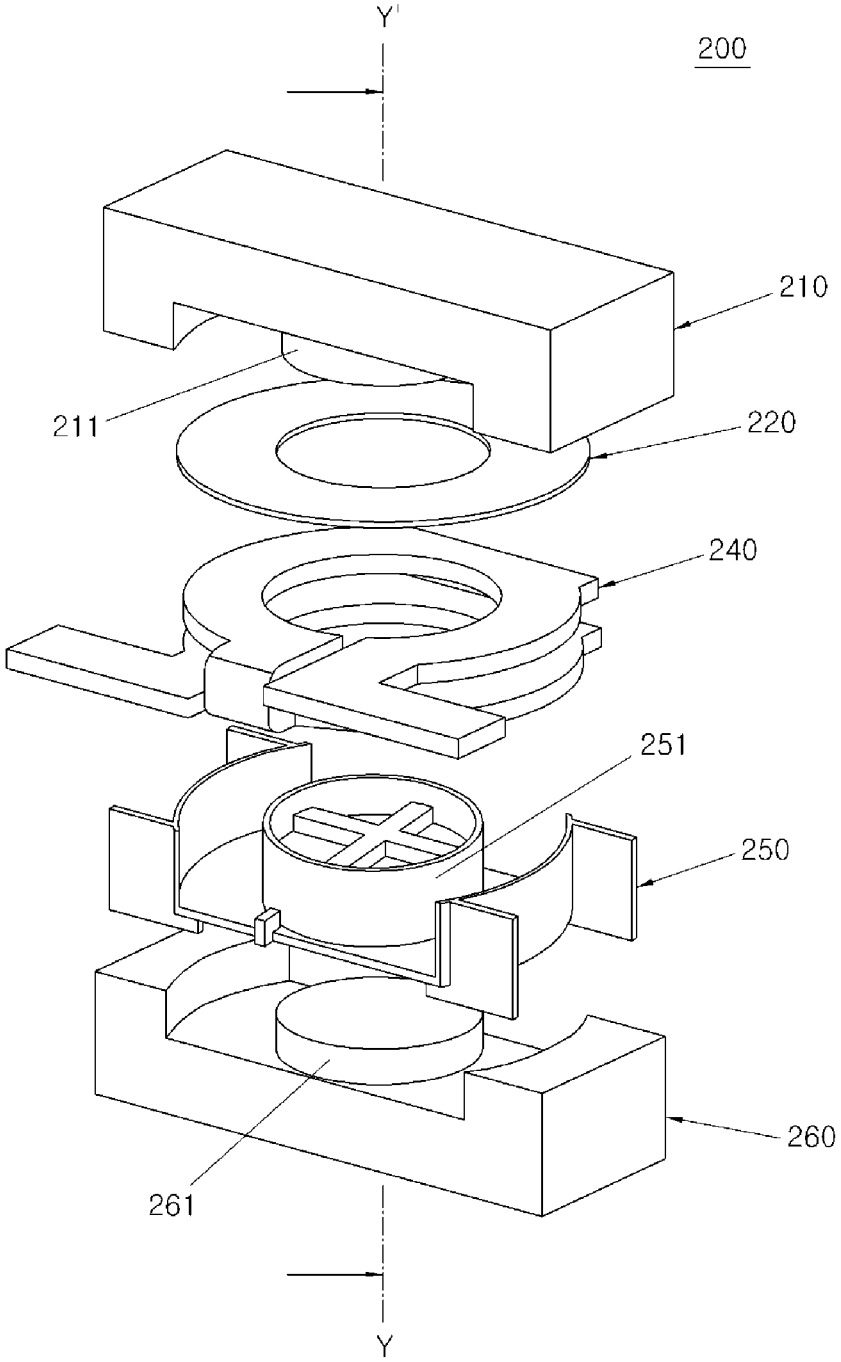
FIG. 2 is a perspective assembly view of a transformer with a bobbin for preventing a crack in accordance with an embodiment of the present invention.

FIG. 2 is a perspective assembly view of a transformer 200 with a bobbin for preventing a crack in accordance with an embodiment of the present invention. Referring to FIG. 2, a transformer 200 with a bobbin for preventing a crack includes a lower core 260 configured to be provided with a lower assembling jaw 261, a bobbin 250 for preventing a crack configured to have a center rib 251 which is provided with a lower core crack preventing part inserted into the lower assembling jaw 261 and the upper core crack preventing part formed at an opposite side to the lower core crack preventing part, having a predetermined thickness, a bus bar 240 configured to penetrate through the center rib 251, an insulating plate 220 configured to be stacked on an upper end surface of the bus bar 240, an upper core 210 configured to be inserted into the insulating plate 220, the bus bar 240, and the upper core crack preventing part, and the like.

The upper core 210 and the lower core 260 are a magnetic core which is a ferrite based material, and the like.

The insulating plate 220 is disposed between the bus bar 240 and the upper core 210 and serves to insulate between two components.

The bus bar 240 serves to conduct electricity. Therefore, as a material of the bus bar, pure copper is used for the purpose of electrical characteristics, but the embodiment of the present invention is not limited thereto, and therefore copper plated with tin may be used for the purpose of corrosion resistance.

Figure 3:
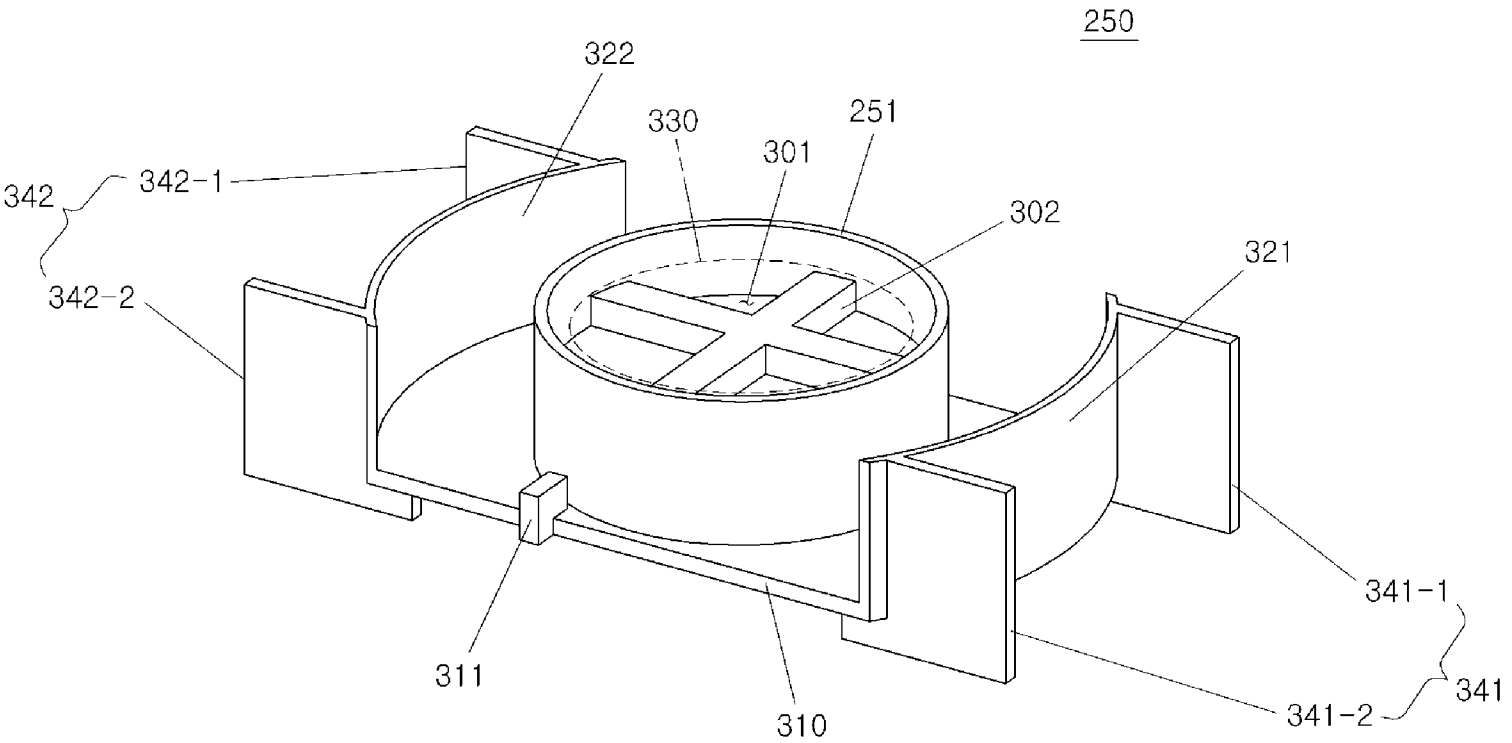
FIG. 3 is an appearance perspective view of the bobbin for preventing a crack illustrated in FIG. 2.

The bobbin 250 for preventing a crack replaces a function of epoxy or impregnation and serves to prevent the upper core 210 and/or the lower core 260 from being damaged due to force, shock, or the like. To this end, the upper core crack preventing part and the lower core crack preventing part are formed inside the center rib 251. This structure is illustrated in FIG. 3. FIG. 3 will be described below.

Continuously describing this with reference to FIG. 2, the bobbin 250 for preventing a crack is directly applied with heat from the bus bar 240, and therefore needs to have heat resistance. Therefore, as a material of the bobbin 250 for preventing a crack, a heat resistant resin is used. An example of the heat resistant resin may include poly phenylene sulfide (PPS), poly amide (PA) 46+ glass fiber (GF) 30, and the like.

FIG. 3 is an appearance perspective view of the bobbin 250 for preventing a crack illustrated in FIG. 2. Referring to FIG. 3, the bobbin 250 for preventing a crack includes a floor plate 310, a first insulating side wall rib 321 and a second insulating side wall rib 322 formed on both surfaces of the floor plate 310, a first bobbin fixing guide rib 341 and a second bobbin fixing guide rib 342 reinforcing the side wall ribs 321 and 322 and serving as a guide when being assembled with the upper and lower cores 210 and 260 (FIG. 2), the center rib 251 formed at a center of the floor plate 310, and the like.

Figure 4:
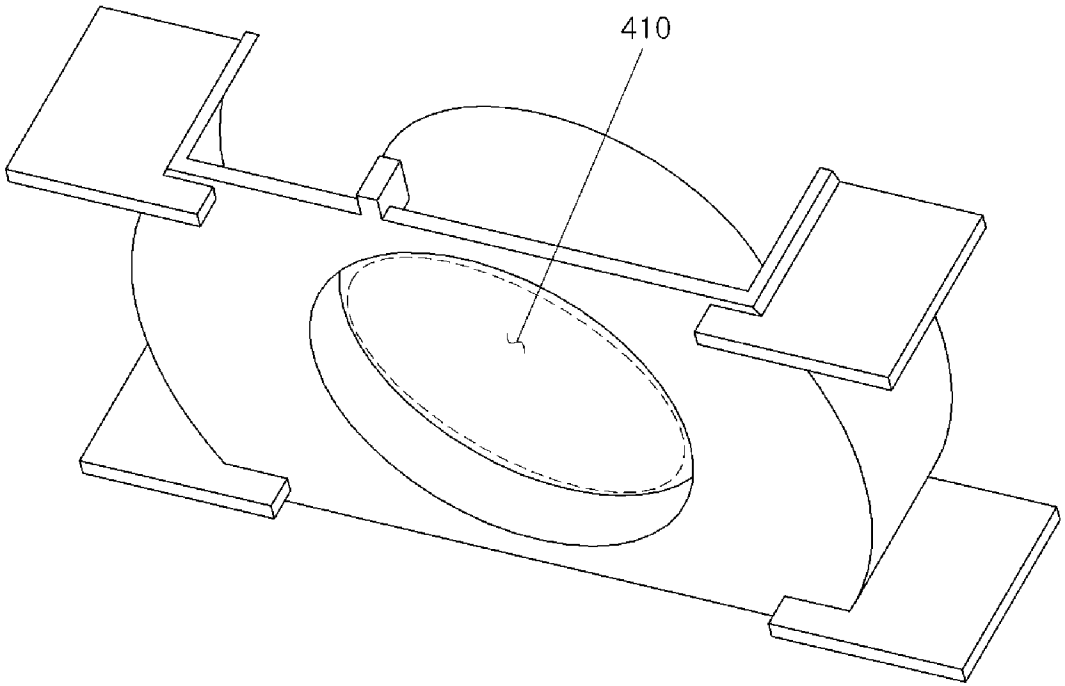
FIG. 4 is a perspective view illustrating a lower core crack preventing part in the bobbin for preventing a crack illustrated in FIG. 3.

The center rib 251 is provided with the upper core crack preventing part 330 and the lower core preventing part. In other words, an inner side of the center rib 251 is provided with a barrier plate 301 and an upper space based on the barrier plate 301 becomes the upper core crack preventing part 330. Further, the lower space based on the barrier plate 301 becomes the lower core crack preventing part. FIG. 4 illustrates the lower core crack preventing part.

Figure 5:
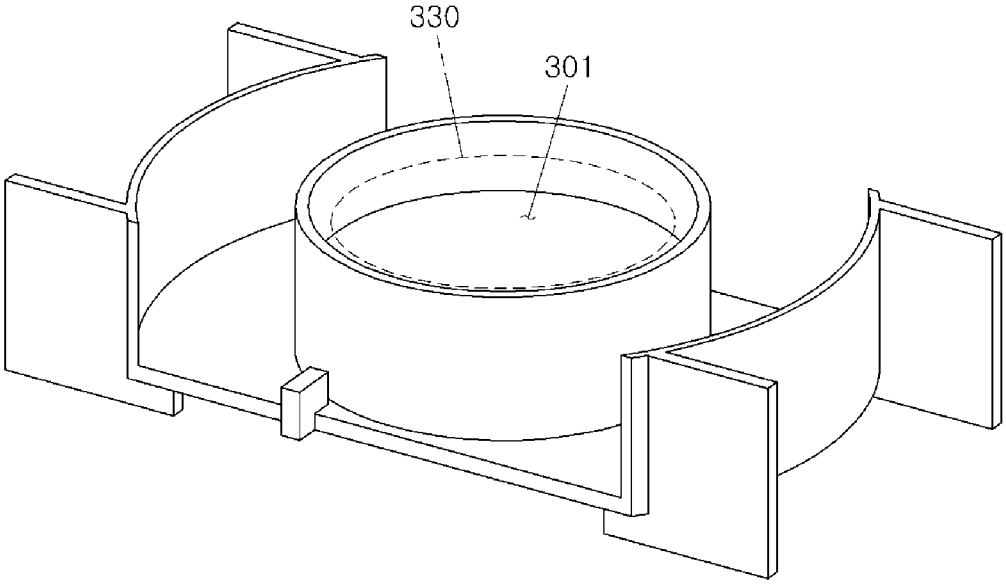
FIG. 5 is a perspective view illustrating an upper core crack preventing part in the bobbin for preventing a crack illustrated in FIG. 3.

Continuously describing this with reference to FIG. 3, the barrier plate 301 may be additionally provided with a gap reinforcing rib 302 depending on a gap between the upper core 210 (FIG. 2) and the lower core 260 (FIG. 2). In other words, two measures may be possible depending on the space of the gap between an upper assembly jaw 211 (FIG. 2) of the upper core 210 and the lower assembly jaw 261 (FIG. 2) of the lower core 260. An example of the two measures is illustrated in FIGS. 4 and 5. This will be described below.

Continuously describing this with reference to FIG. 3, the bobbin fixing guide ribs 341 and 342 serve to secure the bobbin 250 for preventing a crack from shaking after and before the bobbin 250 is seated in the lower core 260 (FIG. 2) and/or the upper core 210 (FIG. 2).

To this end, the first bobbin fixing guide rib 341 is provided with a first pair of wing auxiliary ribs 341-1 and 341-2 and the second bobbin fixing guide rib 342 is provided with a second pair of wing auxiliary ribs 342-1 and 342-2.

Further, a front end of a support of the bobbin 250 for preventing a crack is provided with the bus bar fixing guide rib 311. When the bus bar fixing guide rib 311 is seated in the bobbin 250 for preventing a crack of the bus bar 240 (FIG. 2), the bus bar fixing guide rib 311 is assembled in place and even after the assembling, serves to prevent the shaking.

Further, the barrier plate 301 may be injection-molded simultaneously with the center rib 251. Further, the barrier plate 301, the center rib 251, and the cap reinforcing rib 302 may be simultaneously injection-molded.

The gap reinforcing rib 302 may have various shapes such as a cross shape, a star shape, a check shape, and the like.

FIG. 4 is a perspective view illustrating the lower core crack preventing part in the bobbin 250 for preventing a crack illustrated in FIG. 3. FIG. 4 illustrates an appearance that a lower core crack preventing part 401 is formed at the barrier plate 301. In particular, FIG. 4 illustrates the case in which the gap reinforcing rib 302 (FIG. 3) is additionally formed depending on the space of the gap between the upper core 210 (FIG. 2) and the lower core 260 (FIG. 2). In other words, when an interval of the gap between the upper core 210 (FIG. 2) and the lower core 260 (FIG. 2) is equal to or more than a predetermined size, the gap reinforcing rib 302 is used. In this case, the gap reinforcing rib 302 is added to the barrier plate 301 as much as a thickness thereof.

FIG. 5 is a perspective view illustrating the upper core crack preventing part in the bobbin 250 for preventing a crack illustrated in FIG. 3. In particular, FIG. 4 illustrates a reinforcing method using only the thickness of the barrier plate 301 without using the gap reinforcing rib 302, when the interval of the gap between the upper core 210 (FIG. 2) and the lower core 260 (FIG. 2) is not large.

Therefore, force and/or shock applied to the upper and lower portions is reduced and dispersed through the bobbin 250 for preventing a crack and thus the same function as the no gap type product is performed.

Further, the shapes of the upper core crack preventing part 330 and the lower core crack preventing part 410 may be changed by the space of the upper and lower cores 210 and 260.

Figure 6:
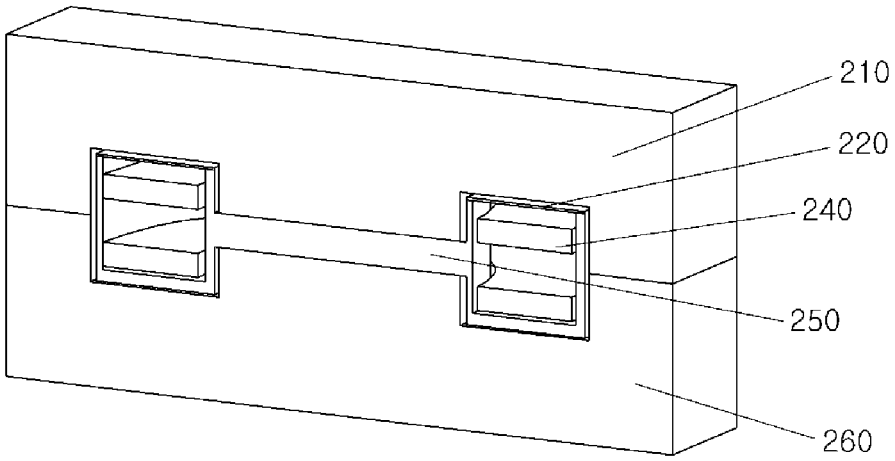
FIG. 6 is a cross-sectional view of a transformer with a bobbin for preventing a crack illustrated in FIG. 2 taken along a Y-Y' axis.

FIG. 6 is a cross-sectional view of a transformer 200 with a bobbin for preventing a crack illustrated in FIG. 2 taken along a Y-Y' axis. Referring to FIG. 6, the upper core 210, the insulating plate 220, the bus bar 240, the bobbin for preventing a crack 250, and the lower core 260 are formed in order from above.

Figure 7:
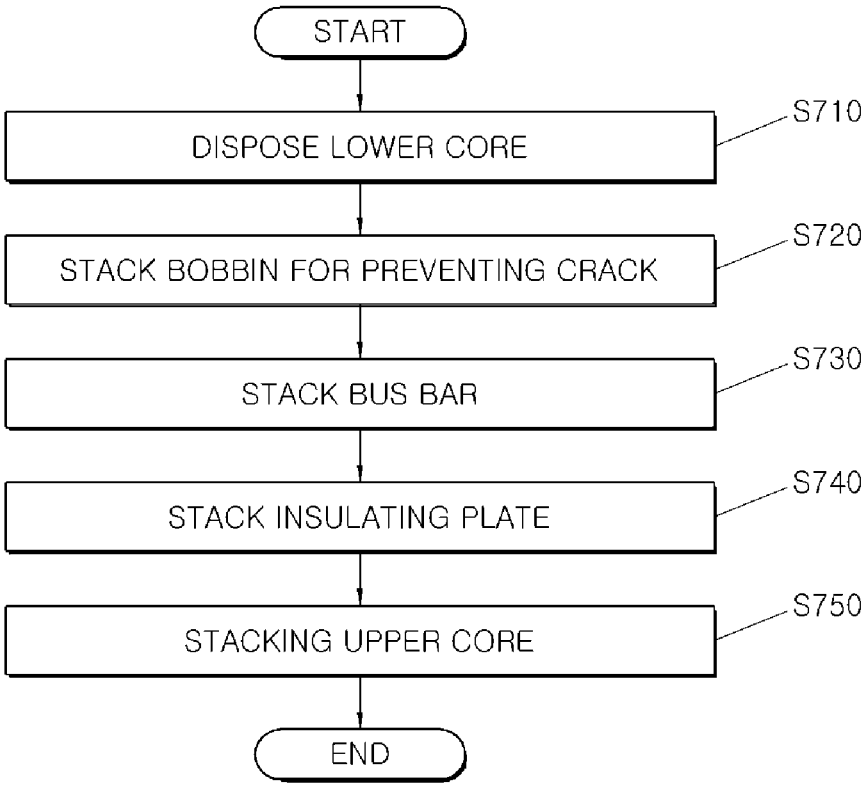
FIG. 7 is a flow chart illustrating an assembling process of the transformer with a bobbin for preventing a crack in accordance with an embodiment of the present invention.

FIG. 7 is a flow chart illustrating an assembling process of the transformer with a bobbin for preventing a crack in accordance with an embodiment of the present invention. Referring to FIG. 7, the lower core 260 (FIG. 2) provided with the lower assembling jaw 211 (FIG. 2) is disposed (S710).

Next, the lower core crack preventing part 410 (FIG. 4) inserted into the lower assembling jaw 211 (FIG. 2) and the bobbin 250 (FIG. 2) for preventing a crack which has the center rib 251 (FIG. 2) provided with the upper core crack preventing part 330 (FIG. 3) formed at an opposite side to the lower core crack preventing part 410, having a predetermined thickness are assembled with the lower core 260 (S720).

Next, the center rib 251 penetrates through the bus bar 240 (FIG. 2) (S730).

Next, the upper end surface of the bus bar 240 is stacked with the insulating plate 220 (FIG. 2) (S740).

Finally, the upper core 210 (FIG. 2) is inserted into the insulating plate 220, the bus bar 240, and the upper core crack preventing part 330 (S750).

On the other hand, in accordance with another embodiment of the present invention, the transformer 200 may be applied to a low voltage DC-DC converter. In this case, the low voltage DC-DC converter is configured to include a power board supplying power to the transformer 200, an output board outputting power transformed by the transformer 200, and the like.

In accordance with the embodiments of the present invention, it is possible to replace the function of epoxy or impregnation by modularizing the bobbin to which the crack preventing structure is applied.

Further, it is possible to reduce the number of assembled components and the man hour since a necessity of the function of epoxy or impregnation is removed by applying the crack preventing structure to the bobbin.

Further, it is possible to reuse the internal components by modularizing the bobbin to which the crack preventing structure is applied.

The foregoing embodiments are only examples to allow a person having ordinary skill in the art to which the present invention pertains (hereinafter, referred to as "those skilled in the art") to easily practice the present invention. Accordingly, the present invention is not limited to the foregoing embodiments and the accompanying drawings, and therefore, a scope of the present invention is not limited to the foregoing embodiments. Accordingly, it will be apparent to those skilled in the art that substitutions, modifications and variations can be made without departing from the spirit and scope of the invention as defined by the appended claims and can also belong to the scope of the present invention.

What is claimed is:

1. A transformer, comprising:

a first core comprising a first protrusion;

a second core comprising a second protrusion facing the first protrusion;

a bobbin interposed between the first and second cores, the bobbin comprising a cylindrical opening and a circumference;

the cylindrical opening receiving at least part of the first protrusion at a first end and further receiving at least part of the second protrusion at a second end;

a winding of at least one conductive wire around the circumference of the bobbin;

a spacer rib placed within the cylindrical opening of the bobbin and interposed between the first protrusion and the second protrusion such that the spacer rib provides a gap between the first protrusion and the second protrusion without an adhesive material bonding and filling the gap between the first protrusion and the second protrusion.

2. The transformer of claim 1, further comprising a barrier plate within the cylindrical opening and interposed between the spacer rib and the first protrusion.

3. The transformer of claim 2, further comprising another barrier plate within the cylindrical opening and interposed between the spacer rib and the second protrusion.

4. The transformer of claim 1, wherein the bobbin further comprises a floor plate interposed between the winding and the second core.

5. The transformer of claim 1, wherein the bobbin is made of poly phenylene sulfide (PPS) or poly amide (PA) 46+glass fiber (GF) 30.

6. The transformer of claim 1, further comprising a bus bar electrically connected to the at least one conductive wire and placed between the first core and the bobbin, wherein the bus bar is made of copper or copper plated with tin.

7. The transformer of claim 2, wherein the barrier plate and spacer rib are in an injection-molded single body.

8. A method of assembling the transformer of claim 1, the method comprising:

providing the first core comprising the first protrusion;

placing the bobbin over the first core such that a portion of the first protrusion is inserted into the cylindrical opening of the bobbin;

placing the spacer rib inside the cylindrical opening over the first protrusion; and placing the second core over the bobbin and the first core such that a portion of the second protrusion is inserted into the cylindrical opening of the bobbin and over the spacer rib such that the spacer rib provides the gap between the first protrusion and the second protrusion.

9. The assembling method of claim 8, wherein no adhesive is applied for providing the gap and bonding between the first and second protrusions in the resulting transformer.

10. The assembling method of claim 9, wherein a barrier plate is interposed between the spacer rib and the first protrusion.

11. The assembling method of claim 9, wherein another barrier plate is interposed between the spacer rib and the second protrusion.

12. The assembling method of claim 8, wherein the bobbin is made of poly phenylene sulfide (PPS) or poly amide (PA) 46+glass fiber (GF) 30.

13. The assembling method of claim 8, wherein a bus bar is placed between the first core and the bobbin, wherein the bus bar is made of copper or copper plated with tin.

14. The transformer of claim 1, wherein the spacer rib is in a cross shape, a star shape or a checker shape when viewed in a direction defined between the first and second protrusions.

* * * * *